US008397830B2

(12) United States Patent
Yagi et al.

(10) Patent No.: US 8,397,830 B2
(45) Date of Patent: Mar. 19, 2013

(54) ELECTRIC STAPLER AND METHOD ADAPTED FOR ELECTRIC STAPLER TO ADJUST STAPLE LEG LENGTH

(75) Inventors: Nobuaki Yagi, Gunma (JP); Hiroshi Udagawa, Gunma (JP)

(73) Assignee: Max Co., Ltd, Tokyo (JP)

( * ) Notice: Subject to any disclaimer, the term of this patent is extended or adjusted under 35 U.S.C. 154(b) by 214 days.

(21) Appl. No.: 12/933,864

(22) PCT Filed: Mar. 25, 2009

(86) PCT No.: PCT/JP2009/055969

§ 371 (c)(1),
(2), (4) Date: Sep. 21, 2010

(87) PCT Pub. No.: WO2009/119675

PCT Pub. Date: Oct. 1, 2009

(65) Prior Publication Data

US 2011/0017797 A1 Jan. 27, 2011

(30) Foreign Application Priority Data

Mar. 25, 2008 (JP) ..... 2008-078838

(51) Int. Cl.
*E21B 4/04* (2006.01)

(52) U.S. Cl. ..... 173/1; 227/82

(58) Field of Classification Search ..... 173/1; 227/82, 227/88, 86, 155
See application file for complete search history.

(56) References Cited

U.S. PATENT DOCUMENTS 5,772,197 A * 6/1998 Aoki et al. ..... 270/58.08
5,794,833 A * 8/1998 Strååt ..... 227/137
6,739,492 B1 * 5/2004 Adams et al. ..... 227/82
2005/0116007 A1 6/2005 Adams

FOREIGN PATENT DOCUMENTS

EP 1090778 A2 4/2001
JP 948556 A 2/1997
JP 2004306538 A * 11/2004

OTHER PUBLICATIONS

Japanese Patent Office, International Search Report for PCT/JP2009/055969, Jun. 8, 2009.
Udo Matzdorf, European Search Report for EP 09725337, Jun. 17, 2011.

* cited by examiner

*Primary Examiner* — M. Alexandra Elve
*Assistant Examiner* — Nathaniel Chukwurah
(74) *Attorney, Agent, or Firm* — Chernoff Vilhauer McClung & Stenzel LLP

(57) ABSTRACT

To adjust a length of each leg of a staple projected to a back side of sheets of paper 5 to be bound according to a thickness thereof. In an electric stapler containing a head portion 2 including a forming plate 12 that forms a straight staple 9*a* so as to be U-shaped and a driver plate 13 that ejects the formed staple, a cartridge including staple sheets stacked with multiple layers, and a stapler main body which supplies the staple sheet below the forming plate 12 and which contains a driving portion that drives the forming plate 12 and the driver plate 13 in the head portion 2, plural head portions 2 are provided in which the forming plate 12 and the driver plate 13 inside have width lengths different from each other, wherein each head portion 2 is attachable to and detachable from the stapler main body.

2 Claims, 4 Drawing Sheets

ELECTRIC STAPLER AND METHOD ADAPTED FOR ELECTRIC STAPLER TO ADJUST STAPLE LEG LENGTH

This is a national stage application filed under 35 USC 371 based on International Application No. PCT/JP2009/055969 filed Mar. 25, 2009, and claims priority under 35 USC 119 of Japanese Patent Application No. 2008-078838, filed Mar. 25, 2008.

TECHNICAL FIELD

The present invention relates to an electric stapler and a method of adjusting a length of each leg of a staple, which adjust the length of each leg of the staple projected from a back side of a bundle of sheets of paper to be bound according to a thickness thereof.

BACKGROUND ART

A stapler generally binds the bundle of sheets of paper to be bound by passing the legs of the staple through the bundle of the sheets of paper and bending them but a thickness of the bundle of the sheets of paper to be bound varies according to number of the sheets and is not fixed. Therefore, if some sheets of paper to be bound are bound by the staple and 40 through 50 sheets of paper to be bound are bound by the same staple, lengths of legs of the staples appeared on the back side of the bundle of sheets of paper when the legs of the staple pass through the bundle of sheets of paper are different from each other. The legs of the staple appeared on the back side of the bundle of sheets of paper are long when the bundle of the sheets of paper to be bound is thin but the legs of the staple appeared on the back side of the bundle of sheets of paper are short when the bundle of the sheets of paper to be bound is thick. However, when the legs of the staple appeared on the back side of the bundle of sheets of paper are long, it looks poor when being bound. It is preferable that the lengths of the legs of the staples projected from the back side of the bundle of the sheets of paper to be bound are as identical as possible.

As means for coping with this, a method of preparing some cartridges respectively loading the staples with legs having different lengths and using different cartridges for different thicknesses of the bundle of the sheets of paper to be bound and a method of cutting the too long legs of the staple when the bundle of the sheets of paper to be bound is thin (see Japanese Patent Application Publication No. 2005-119246) have been known. Particularly, in the stapler mounted on an expensive high-speed copy machine, it is necessary to provide a cutting mechanism for making uniform the lengths of legs of the staples projected from a back side of the bundle of the sheets of paper to be bound.

DISCLOSURE OF THE INVENTION

Problems to be Solved by the Invention

However, in the first method, some cartridges are required to be prepared so that a species of staple is increased, thereby resulting in an increased costs. Further, in the second method, the cutting mechanism is complicated so that numbers of parts are increased. It is also very difficult to collect cut pieces from the legs of the staple, which are dropped after they are cut, not so as to be scattered, so that a mounting angle of the cutting mechanism is often limited. Thus, it is desirable that a technology of making uniform the lengths of legs of the staples after binding without cutting the legs of the staple is developed.

The invention solves the above-mentioned problems, and it is an object of the invention to provide an electric stapler and a method of adjusting a length of each leg of staple in the electric stapler, by which the length of each leg of the staple projected from a back side of the bundle of sheets of paper to be bound is adjustable according to a thickness of the bundle of the sheets of paper to be bound by adjusting a width of a crown portion provided on a middle of the staple.

Means for Solving the Problems

In order to solve the above-mentioned problems, an invention claimed in claim 1 contains a cartridge including staple sheets stacked with multiple layers, each staple sheet being composed of a plurality of straight staples connected to each other, a head portion including a forming plate that forms each of the straight staples so as to be U-shaped, an anvil, and a driver plate that ejects the formed staple, and a stapler main body supplying the staple sheet below the forming plate and containing a driving portion that drives the forming plate and the driver plate in the head portion, characterized in that plural head portions having the forming plates, the anvils and the driver plates, which have different width lengths from each other, are provided, and the head portions are selected according to a thickness of the bundle of the sheets of paper to be bound so as to be mounted onto the stapler main body.

In order to solve the above-mentioned problems, an invention claimed in claim 2 is a method of adjusting a length of each leg of a staple in an electric stapler, the stapler containing a cartridge including staple sheets stacked with multiple layers, each staple sheet being composed of a plurality of straight staples connected to each other, a head portion including a forming plate that forms each of the straight staples so as to be U-shaped, an anvil, and a driver plate that ejects the formed staple, and a stapler main body supplying the staple sheet below the forming plate and containing a driving portion that drives the forming plate and the driver plate in the head portion, characterized in that when adjusting the length of each leg of the staple formed according to a thickness of the bundle of sheets of paper to be bound, plural head portions having inside the forming plates, the anvils and driver plates, which have different width lengths from each other, are prepared as the head portion, and each head portion is attachable or detachable to or from the stapler main body, and the head portions are selected according to a thickness of the bundle of the sheets of paper to be bound so as to be mounted onto the stapler main body.

According to the inventions claimed in claims 1 and 2, the width length of the forming plate in each of the head portions is mutually different from the width length of the forming plate in other head portion. This allows a length of a crown portion of the staple formed by the forming plate provided in each head portion and a length of each leg of the staple bent along both sides thereof to be fixed by the width length of the forming plate when mounting the head portion onto the stapler main body to perform binding operations even if the straight staples supplied from the cartridge have the same length. Since the width lengths of the forming plates in the respective head portions are different from each other, the legs are short (or the crown portion is long) if the forming plate is wide but the legs are long (or the crown portion is short) if the forming plate is narrow. Thus, when the bundle of the sheets of paper to be bound is thin, the head portion is selected and mounted which is provided with the wide forming plate. Alternatively, when the bundle of the sheets of paper to be bound is thick, the head portion is selected and mounted which is provided with the narrow forming plate. This enables the legs each having suitable length to be put in an appearance on the back side of the bundle of the sheets of paper, which is bound. Therefore, it is possible to bind them the bundle of the sheets of paper to be bound so as to be fine in appearance in either case.

The invention claimed in claim 3 is the method according to claim 2, characterized in that the head portion is positioned between the driving portion and the cartridge and the head portion is attachable or detachable after the cartridge is detached.

According to the invention claimed in claim 3, the head portion is positioned between the driving portion and the cartridge and is attachable or detachable after the cartridge is detached so that when the electric stapler is mounted inside any device such as a copy machine, a printer and the like, the head portion may be attached or detached after the cartridge is detached, thereby enabling a replacing operation of the head portion to be performed within a narrow space.

The invention claimed in claim 4 is the method according to claim 2, characterized in that a magazine is provided on the stapler main body so as to be slidable, the cartridge is provided so as to be rotatable in relation to the magazine and the head portion is provided so as to be attachable or detachable to or from the cartridge.

According to the invention claimed in claim 4, the magazine is provided so as to be slidable along magazine rails provided on the stapler main body, the cartridge is provided so as to be rotatable in relation to the magazine and the head portion is provided so as to be attachable or detachable to or from the cartridge. Thus, since the head portion may be attached or detached after the cartridge is detached when replacing the head portions, it is possible to perform the replacing operation of the head portions even if there is only a narrow space in a case of mounting the electric stapler on an interior of the device such as a copy machine, a printer and the like.

BEST MODE FOR CARRYING OUT THE INVENTION

Figure 1:
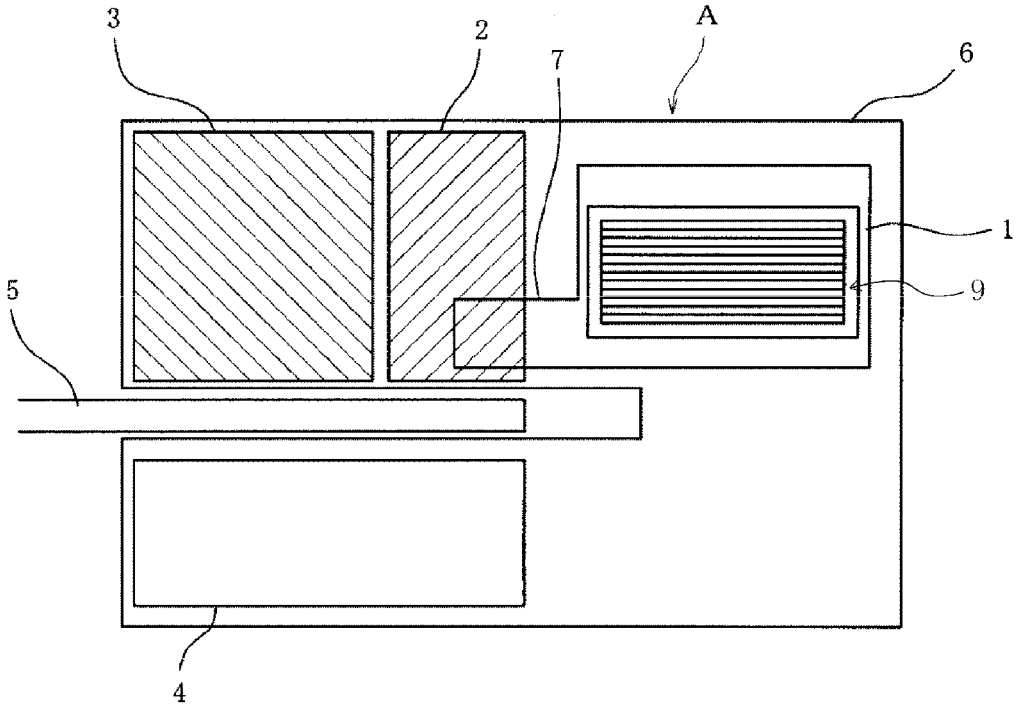
FIG. 1 is a schematic view of an electric stapler A according to an embodiment of the present invention.

The following will describe embodiments of the invention based on embodied examples shown in the drawings. FIG. 1 shows an electric stapler A according to an embodiment of the present invention. The electric stapler A is a built-in electric stapler, which is built in an apparatus such as a copy machine, a printer, a facsimile machine and the like or a sheet-processing device connected with any of these apparatuses and which automatically binds predetermined number of sheets of paper copied, printed or facsimiled. This electric stapler A is constructed so that staple sheets, each staple sheet being composed of a plurality of straight staples that are arranged in a row and adhered to each other to form a sheet, are supplied successively to an ejecting portion, a top straight staple of the staple sheet supplied to the ejecting portion is formed so as to be U-shaped just before it has been ejected, and the U-shaped staple is then ejected toward the bundle of the sheets of paper to be bound.

As shown in FIG. 1, such an electric stapler A comprises a cartridge 1 including a plurality of the staple sheets stacked with multiple layers, a head portion 2 including means for forming each of the straight staples included in the cartridge 1 so as to be U-shaped and ejecting it toward the bundle of the sheets of paper 5 to be bound, a driving portion 3 electrically driving the above-mentioned means of the head portion 2, and a clincher portion 4 that is operated to clinch legs of staple passed through the bundle of the sheets of paper 5 to be bound along a lower surface of the bundle of the sheets of paper 5 to be bound. The driving portion 3 and the clincher portion 4 are provided on a stapler main body 6 and the cartridge 1 and the head portion 2 are provided so as to be attachable or detachable to or from the stapler main body 6. It is to be noted that the head portion 2 is positioned between the driving portion 3 and the cartridge 1.

Figure 2:
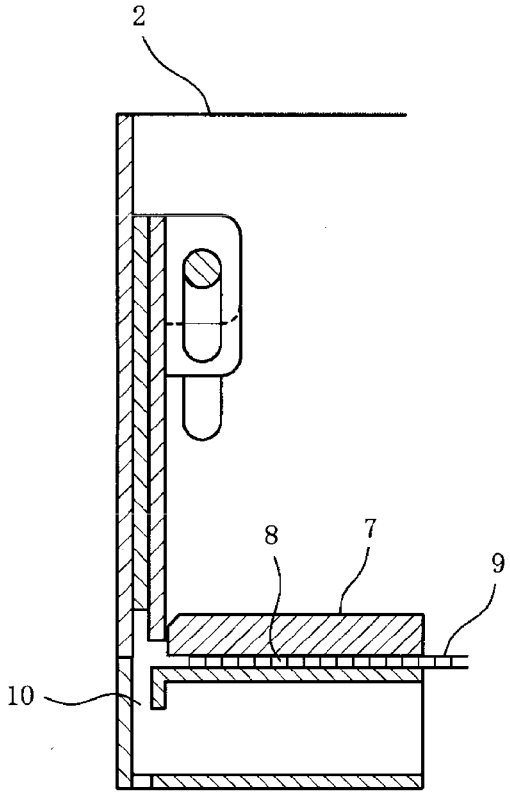
FIG. 2 is a side view illustrating an internal configuration of a head portion 2.

An opening, not shown, for discharging the lowest staple sheet 9 to the head portion 2 is formed in a side wall of the cartridge 1 at a side of the head potion 2 and a projecting portion 7 is continuously formed from the opening. A guide portion 8 for the staple sheet 9 is formed in the projecting portion 7 as shown in FIG. 2. Further, an ejecting portion 10 for ejecting the top staple is formed in front thereof so as to be made open upward and downward. The guide portion 8 is formed so as to have the same width as that of the staple sheet 9 and the ejecting portion 10 is formed so as to have the width wider than that (a width of the crown portion) of the U-shaped staple. The projecting portion 7 is mounted so as to be fitted into an interior of the head portion 2.

Figure 3A:
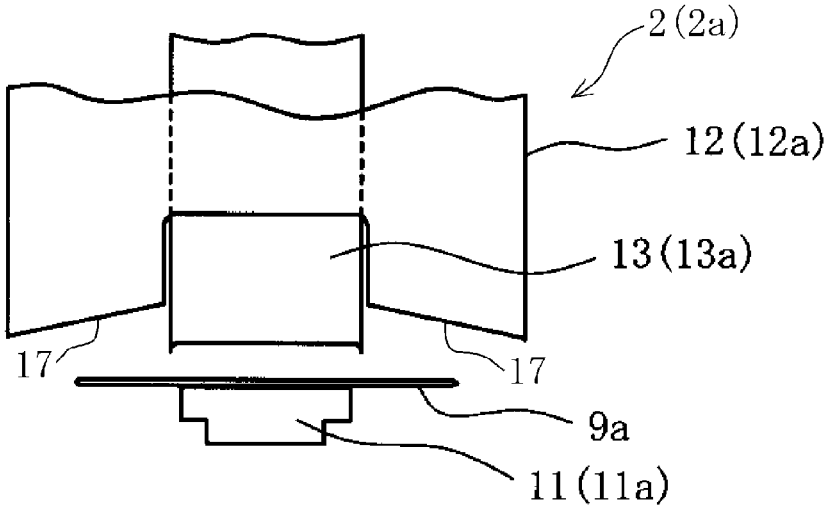
FIG. 3A is a front view illustrating an example in which a top straight staple 9*a* is positioned between an anvil 11*a* and a forming plate 12*a*.
Figure 3B:
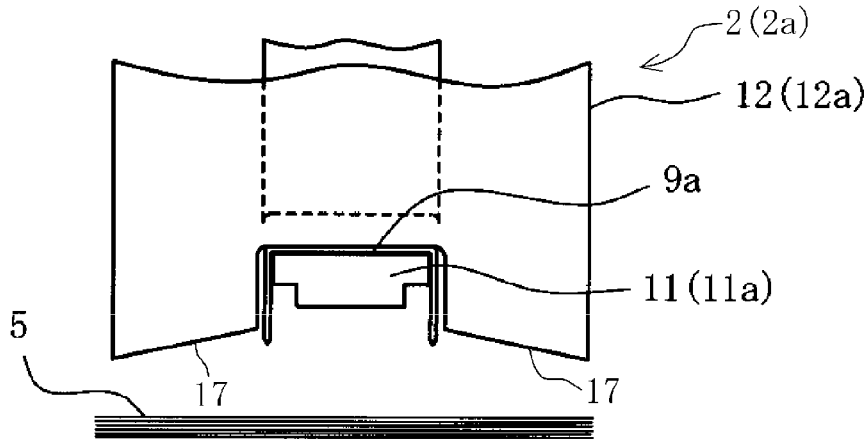
FIG. 3B is a front view illustrating an example in which the straight staple 9*a* is formed so as to be U-shaped by cooperating the anvil 11*a* and the forming plate 12*a*.
Figure 3C:
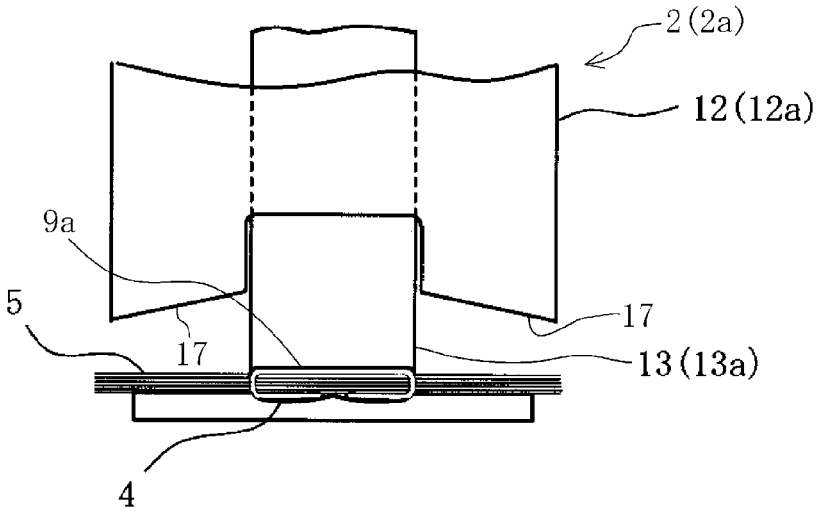
FIG. 3C is a front view illustrating an example in which the staple 9*a* formed so as to be U-shaped is ejected by a driver plate 13*a* to bind the bundle of the sheets of paper 5 to be bound.

The top staple 9*a* of the stale sheet 9 introduced from the opening of the cartridge 1 is sent to the head portion 2, as shown in FIGS. 3A through 3C, and stops on an anvil 11 positioned before the ejecting portion 10 by sending means.

In the head portion 2, a forming plate 12 that has a forming portion with a gate shape at its forward end and forms the top straight staple 9*a* so as to be U-shaped by cooperation with the anvil 11 and a driver plate 13 that ejects the staple 9*a* formed and sent in an ejecting path by the forming plate 12 toward the bundle of the sheets of paper 5 to be bound are located so as to lay one on top of another.

By the way, in the head portion 2, plural head portions 2 are prepared in which width lengths of the forming plate 12 and the driver plate 13 are different from each other. For example, as shown in FIGS. 3A through 3C and FIGS. 4A through 4C, two species of the head portions may be used which includes a head portion 2*a* providing with the wide forming plate 12*a* and the narrow driver plate 13*a* in a pressing portion 17 and a head portion 2*b* providing with the narrow forming plate 12*b* and the wide driver plate 13*b* in a pressing portion 18, or three species or more thereof may be used. Each of the head portions 2*a*, 2*b* is attachable or detachable to or from the stapler main body 6. It is to be noted that the anvils 11 are also prepared which include a narrow anvil 11*a* and a wide anvil 11*b* according to the widths of the forming plate 12 and the driver plate 13. The anvil 11 may be adjusted in its width according to the widths of the forming plate 12 and the driver plate 13.

The driving portion 3 drives the forming plate 12 and the driver plate 13 using a driving mechanism, not shown, operationally connected to an electric motor.

The clincher portion 4 is provided at a position, which corresponds to the ejecting path, across a space for inserting the bundle of the sheets of paper 5 to be bound. It is configured that the staple supplied into the ejecting path by the driver plate 13 is ejected toward the bundle of the sheets of paper 5 to be bound and tips of the legs of the staple passed through the bundle of the sheets of paper 5 to be bound attach the clincher portion 4, thereby enabling them being clinched along the lower surface of the bundle of the sheets of paper 5 to be bound.

It is to be noted that a width of the clincher portion 4 may be changed according to the widths of the forming plate 12 and the driver plate 13 in the driving portion 3.

Figure 4A:
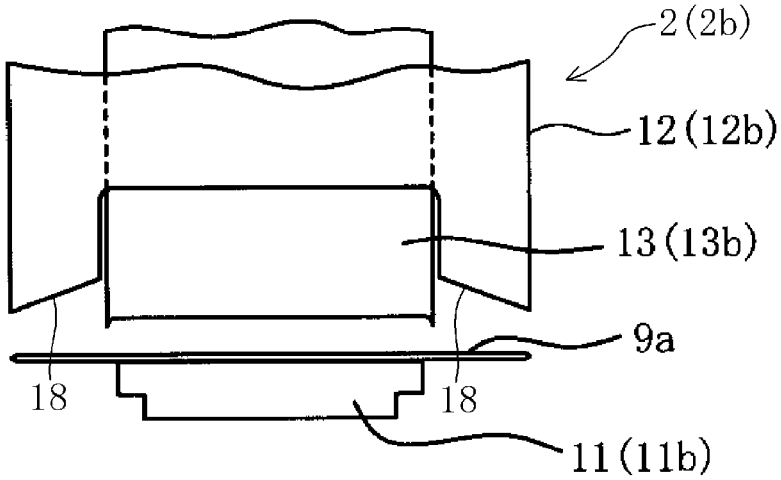
FIG. 4A is a front view illustrating an example in which a top straight staple 9*a* is positioned between an anvil 11*b* and a forming plate 12*b*.
Figure 4B:
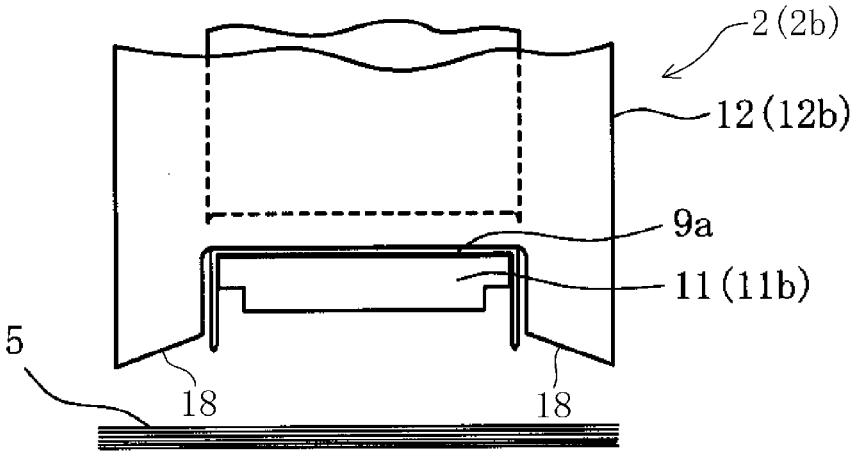
FIG. 4B is a front view illustrating an example in which the straight staple 9*a* is formed so as to be U-shaped by cooperating the anvil 11*b* and the forming plate 12*b*.
Figure 4C:
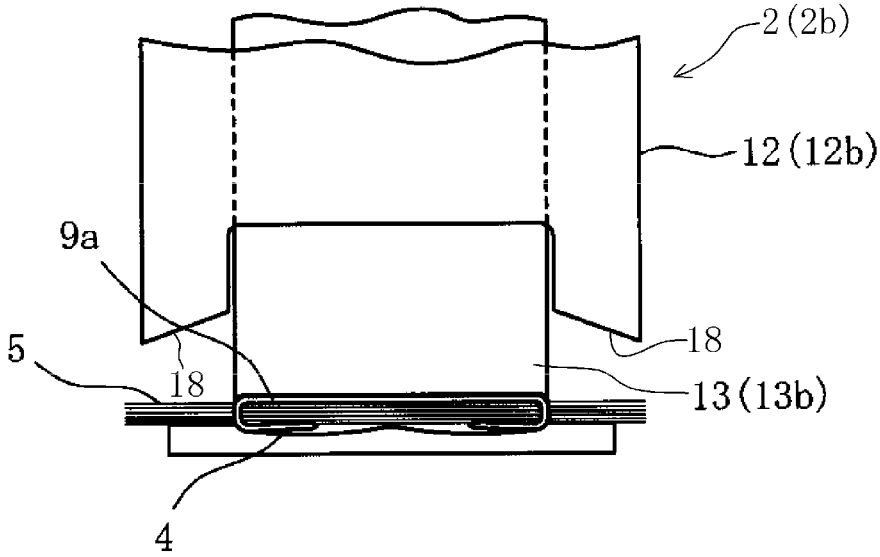
FIG. 4C is a front view illustrating an example in which the staple 9*a* formed so as to be U-shaped is ejected by a driver plate 13*b* to bind the bundle of the sheets of paper 5 to be bound.

According to the above-mentioned configuration, the top staple 9*a* of the staple sheet 9 introduced from the cartridge 1 is sent onto the anvil 11 positioned below the forming plate 12 before the ejecting portion 10. When the driving portion 3 drives the forming plate 12 and the driver plate 13, as shown in FIGS. 3B and 4B, the top straight staple 9*a* is first formed so as to be U-shaped by the forming plate 12 and is supplied to the ejecting path. Next, as shown in FIGS. 3C and 4C, it is ejected by the driver plate 13 from the ejecting path toward the bundle of the sheets of paper 5 to be bound. The tips of the legs of staple passed through the bundle of the sheets of paper 5 to be bound attach the clincher portion 4 so that they are clinched along the lower surface of the bundle of the sheets of paper 5 to be bound, by which the binding operation is complete.

As described above, the straight staple 9*a* is formed so as to be U-shaped by a forming portion of the forming plate 12 and ejected by the driver plate 13. If the forming plate 12 is the forming plate 12*b* having a narrow width in the pressing portion 18, the formed staple becomes long in its crown portion at a middle thereof and short in its legs. On the contrary, if the forming plate 12 is the forming plate 12*a* having a wide width in the pressing portion 17, the formed staple becomes short in its crown portion at a middle thereof and long in its legs. Thus, the lengths of the crown portion at the middle of the staple and the legs thereof at its both sides are fixed on the basis of the width length of the forming plate 12.

Therefore, if the bundle of the sheets of paper 5 to be bound is thick, the head portion 2*a* providing with the forming plate 12*a* having a wide width in the pressing portion 17 is mounted as shown in FIGS. 3A through 3C. Alternatively, if the bundle of the sheets of paper 5 to be bound is thin, the head portion 2*b* providing with the forming plate 12*b* having a narrow width in the pressing portion 18 is mounted as shown in FIGS. 4A through 4C. This enables the legs each having suitable length to be put in an appearance on the back side of the bundle of the sheets of paper 5, which is bound. Thus, by utilizing the head potions 2 with them being replaced according to the thickness of the bundle of the sheets of paper 5 to be bound, it is possible to bind the bundle of the sheets of paper 5 to be bound so as to be fine in appearance in either case.

Figure 5:
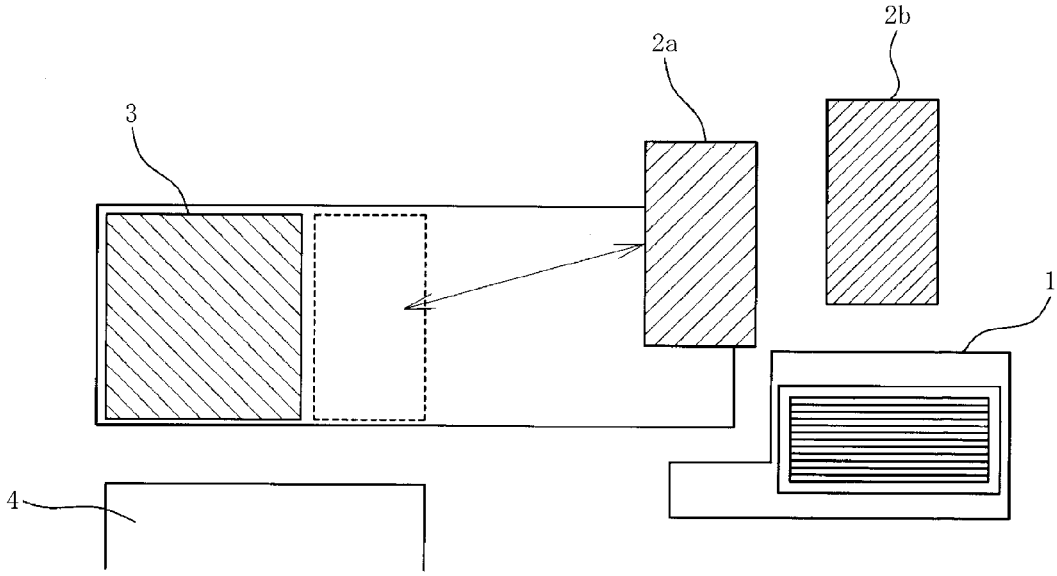
FIG. 5 is a schematic view of head portions 2*a*, 2*b* for illustrating an attached and detached state thereof.

Further, the head portion 2 is positioned between the driving portion 3 and the cartridge 1 and is attachable or detachable after the cartridge 1 is detached. When the electric stapler is mounted inside any device such as a copy machine, a printer and the like, the head portions 2*a*, 2*b* may be attached or detached after the cartridge 1 is detached, as shown in FIG. 5, thereby enabling a replacing operation of the head portions 2*a*, 2*b* to be performed within a narrow space.

Figure 6:
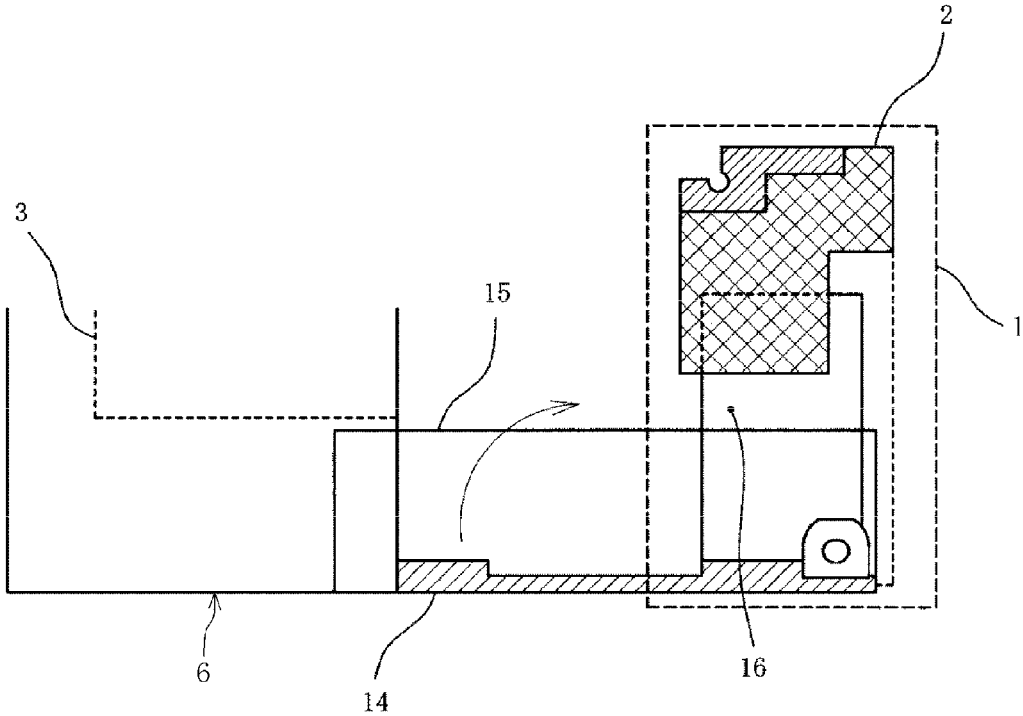
FIG. 6 is a schematic view illustrating another attached and detached configuration of the head portion 2 and a cartridge 1.

It is to be noted that a configuration of attaching and detaching the cartridge 1 and the head portions 2 is not limited the above-mentioned cases. For example, as shown in FIG. 6, a magazine 15 is provided on the stapler main body 6 so as to be slidable along magazine rails 14 provided thereon. The cartridge 1 including the staple sheets may be provided so as to be rotatable in relation to the magazine 15 and the head portion 2 may be provided so as to be attachable or detachable to or from the cartridge 1. Number, "16" represents staple sheets for refill, which have been filled within the cartridge 1.

According to the above-mentioned configuration, when replacing the head portions 2, the head portions 2 and the cartridge 1 may be attached or detached after the magazine 15 is drawn along the magazine rails 14. This enables the replacing operation of the head portions 2 to be performed even if there is only a narrow space in a case of mounting the electric stapler on an interior of the apparatus such as a copy machine, a printer and the like.

The invention claimed is:

1. A method of adjusting a length of each leg of staple in an electric stapler, the stapler containing a cartridge including staple sheets stacked with multiple layers, each staple sheet being composed of a plurality of straight staples connected to each other, the cartridge being attachable or detachable by itself, a head portion including a forming plate that forms each of the straight staples so as to be U-shaped, an anvil, and a driver plate that ejects the formed staple, and a stapler main body supplying the staple sheet below the forming plate and containing a driving portion that drives the forming plate and the driver plate in the head portion, the method comprising the steps of:

preparing plural head portions having inside the forming plates, the anvils and the driver plates, which have different width lengths from each other, as the head portion when adjusting the length of each leg of the staple formed according to a thickness of the bundle of the sheets of paper to be bound, the head portions being attachable or detachable to or from the stapler main body;

selecting any one from the head portions according to a thickness of the bundle of the sheets of paper to be bound so as to be mounted onto the stapler main body;

attaching the cartridge to the stapler main body so as to face the driving portion of the stapler main body through the selected head portion;

detaching the cartridge facing the driving portion through the selected head portion from the stapler main body toward a direction where the cartridge is moved apart from the selected head portion and the driving portion; and detaching the selected head portion from the stapler main body after the cartridge is detached and attaching a head portion other than the selected head portion to the stapler main body.

2. The method of adjusting the length of each leg of staple in the electric stapler according to claim 1, wherein a magazine is provided on the stapler main body so as to be slidable, the cartridge is provided so as to be rotatable in relation to the magazine and the head portion is provided so as to be attachable or detachable to or from the cartridge.

* * * * *